United States Patent [19]

Burckett St. Laurent et al.

[11] Patent Number: 4,806,253

[45] Date of Patent: Feb. 21, 1989

[54] LAUNDRY COMPOSITIONS

[75] Inventors: James C. T. R. Burckett St. Laurent, Overijse; Alfred Busch, Grimbergen, both of Belgium

[73] Assignee: The Procter & Gamble Company, Cincinnati, Ohio

[21] Appl. No.: 868,176

[22] Filed: May 23, 1986

Related U.S. Application Data

[63] Continuation of Ser. No. 670,681, Nov. 13, 1984, abandoned.

[51] Int. Cl.[4] ..... D06M 11/00

[52] U.S. Cl. ..... 252/8.8; 252/8.6; 252/528; 252/547

[58] Field of Search ..... 252/8.6, 8.8, 528, 547

[56] References Cited

U.S. PATENT DOCUMENTS

| | | | |
|---|---|---|---|
| 3,966,629 | 6/1976 | Dumbrell | 252/528 |
| 4,292,035 | 9/1981 | Battrell | 252/547 |
| 4,294,710 | 10/1981 | Hardy et al. | 252/8.8 |
| 4,321,165 | 3/1982 | Smith et al. | 252/528 |
| 4,338,204 | 7/1982 | Spadini et al. | 252/528 |
| 4,375,416 | 3/1983 | Crisp et al. | 252/525 |

FOREIGN PATENT DOCUMENTS

| | | |
|---|---|---|
| 1400898 | 7/1975 | United Kingdom . |
| 1483627 | 8/1977 | United Kingdom . |
| 1514276 | 7/1978 | United Kingdom . |

*Primary Examiner*—Paul Lieberman
*Assistant Examiner*—Willie J. Thompson

[57] ABSTRACT

Fabric softening is provided by water-soluble di-$c_{6-10}$ quaternary ammonium salts and clay. Through-the-wash fabric softening is achieved concurrently with fabric cleaning by means of clays and water-soluble quaternaries. Compositions and sheet-form articles embodying soluble quaternary softeners are described.

9 Claims, No Drawings

LAUNDRY COMPOSITIONS

This application is a continuation of application Ser. No. 670,681, filed Nov. 13, 1984, now abandoned.

TECHNICAL FIELD

The present invention relates to means of softening fabrics, wherein water-soluble quaternary ammonium salts are used to provide fabric softness and anti-static benefits. Detergent compositions in spray-dried form containing said salts and a smectite clay softener are disclosed. The quaternaries herein may also be used in sheet form.

BACKGROUND

The use of softeners to treat fabrics subsequent to a washing operation is a well-known laundering practice. Fabric softeners are, in the main, water-insoluble cationic materials that are incompatible with anionic detersive surfactants used in most fabric washing compositions. For that reason, the softening operation is generally carried out in the laundry rinse bath after the surfactant has been removed from the washing machine. This entails additional work for the user.

Formulators of fabric laundering compositions have long sought means whereby the fabric washing and softening could be done concurrently. Methods employing clay softeners, mixtures of clays and various amine materials and the like, are described in the following patents: German Pat. Nos. 29/64114.3, 28/57163.3, 24/39541.3, 23/34899.4 and EPO Nos. 80200570.2, 80200877.1 and 80201015.7. The use of mixtures of amines and soaps (salts of fatty acids) as through-the-wash softeners is disclosed in U.K. Pat. No. 1 514 276.

The prior art also describes the use of various cationic materials in sheet form. See U.S. Pat. No. 4,220,562.

The present invention employs a water soluble quaternary ammonium salt in an otherwise conventional spray-dried detergent composition matrix, and clay, to provide cleaning and softening concurrently, through-the-wash. The quaternary ammonium salts used herein provide improved softening and anti-static benefits, especially when applied to polyester fabrics and/or when the compositions herein are used at relatively high laundering temperatures (60° C., and above).

SUMMARY OF THE INVENTION

The detergent compositions (preferably, spray-dried) herein may be described succinctly as containing conventional detergent ingredients such as detersive surfactants (including anionics), detergency builders, optical brighteners, detersive enzymes, fabric bleaches, and the like, all at rather conventional levels, as well as clay fabric softeners (preferably, smectite clays), said compositions being characterized in that they contain at least 0.1% (preferably 1.0% to 15%) of a water-soluble di-$C_{6-10}$ alkyl quaternary ammonium salt. The compositions are formulated to contain not more than 3% (preferably not more than 1%–2%) of a nonionic detersive surfactant.

The invention also encompasses methods for softening fabrics by contacting same with a water-soluble di-$C_{6-10}$ quaternary ammonium salt and a smectite clay.

The invention also encompasses an article for use in a laundary bath or rinse bath, or in a laundary dryer, comprising said quaternary salts, and preferably used in a laundry bath in combination with a bleach activator.

The ingredients and means for preparing the compositions are disclose more fully hereinafter. All weights and proportions are by weight, unless otherwise specified.

DETAILED DESCRIPTION OF THE INVENTION

As noted hereinafter, the detergent compositions of this invention comprise, in major part, conventional ingredients that are quite familiar to formulators of granular detergent compositions. One of the major advantages of the water-soluble quaternary ammonium salts used herein is that they are entirely compatible with such conventional detergent ingredients, used at conventional concentrations (with the exception of the nonionic detersive surfactants).

WATER-SOLUBLE QUATERNARY AMMONIUM SALTS

The water-soluble quaternaries employed herein are the di-$C_{6-10}$ materials, such as the dimethyl di-$C_6$–$C_{10}$ ammonium bromides, chlorides and methylsulfates. An article appearing in "Seifen-Öle Fette-Wachse" Nr 10-2. Juniheft June 19, 1975, beginning at page 273, describes such materials and discloses that they are commercially available under the Trademark "Bardac".

The article describes the antimicrobial properties of these quaternaries and mentions (page 275) their use with anionic and nonionic detergents.

However, this article does not disclose the use of these quaternaries in compositions of the present type, with restricted amounts of nonionic surfactants, nor with softener clays, to soften fabrics in the manner of the present invention.

The compounds preferred for use herein (at preferred 1%–5% levels) are the di-octyl dimethyl-, didecyl dimethyl- and octyldecyl dimethylammonium salts, e.g., chlorides and bromides, or mixtures thereof. Ethyl, propyl or butyl may be substituted for methyl, so long as the compounds are water-soluble. Methyl is preferred.

The quaternaries are used in combination with a smectite clay softener, most preferably, at a weight ratio of quaternary: clay in the range of 1:100 to 100:1, preferably 0.5:1 to 1:1.

Softener Clay: The above-disclosed quaternaries are most preferably used in granular detergent compositions, where they are used in combination with a detergent-compatible clay fabric softener. Such clay softeners are well-known in the detergency patent literature and are in broad commercial use, both in Europe and in the United States. Included among such clay softeners are various heat-treated kaolins and various multi-layer smectites. Preferred clay softeners are smectite softener clays that are described in German patent document No. 2 334 899 and in U.K. Pat. No. 1 400 898 which can be referred to for details. Softener clays are used in the preferred compositions at levels of at least 1%, generally 1–20%, preferably 2–7%.

Detersive Surfactants: The detergent compositions of this invention will contain organic surface-active agents ("surfactants") to provide the usual cleaning benefits associated with the use of such materials.

Detersive surfactants useful herein include well-known synthetic anionic, amphoteric and zwitterionic surfactants. Typical of these are the alkyl benzene sulfonates, alkyl- and alkylether sulfates, paraffin sulfonates, olefin sulfonates, amine oxides, α-sulfonates of fatty acids and of fatty acid esters, and the like, which are well-known from the detergency art. In general, such detersive surfactants contain an alkyl group in the $C_9$–$C_{18}$ range; the anionic detersive surfactants can be used in the form of their sodium, potassium or triethanolammonium salts. U.S. Pat. Nos. 4,111,855 and 3,995,669 contain detailed listings of such typical detersive surfactants. $C_{11}$–$C_{16}$ alkyl benzene sulfonates, $C_{12}$–$C_{18}$ paraffin-sulfonates and alkyl sulfates are especially preferred in the compositions of the present type.

Also useful herein as the surfactant are the water-soluble soaps, e.g. the common sodium and potassium coconut or tallow soaps well-known in the art.

It is to be understood that the use of typical alkoxylated nonionic surfactants (e.g. the $C_9$–$C_{18}$ alkyl alcohols and alkyl phenols with 5 to 20 ethoxyl groups) should be limited in the practice of this invention to levels of not more than about 3%, preferably not more than 2%, most preferably 0–1%, of the compositions. Such alkoxylates interfere with the softening properties of the compositions. However, a limited amount (as stated) may be used to disperse optical brightener in the compositions, and to reduce dustiness, according to the desires of the formulator.

The surfactant component (other than alkoxylated nonionic) can comprise as little as 1% of the compositions herein, but preferably the compositions will contain 5% to 40%, preferably 6% to 30%, of surfactant. Mixtures of the anionics, such as the alkyl benzene sulfonates, alkyl sulfates and paraffin sulfonates are preferred for through-the-wash cleansing of a broad spectrum of soils and stains from fabric.

Detersive Adjuncts: The compositions herein can contain other ingredients which aid in their cleaning performance. For example, it is highly preferred that through-the-wash detergent compositions contain a detergent builder and/or metal ion sequestrant. Compounds classifiable and well-known in the art as detergent builders include the nitriliotriacetates, polycarboxylates, citrates, water-soluble phosphates such as tri-polyphosphate and sodium ortho- and pyro-phosphates, silicates, and mixtures thereof. Metal ion sequestrants include all of the above, plus materials like ethylenediaminetetraacetate, the amino-polyphosphonates and phosphates (DEQUEST) and a wide variety of other poly-functional organic acids and salts too numerous to mention in detail here. See U.S. Pat. No. 3,579,454 for typical examples of the use of such materials in various cleaning compositions. In general, the builder/sequestrant will comprise about 0.5% to 45% of the composition. The 1–10 micron size zeolite (e.g. zeolite A) builders disclosed in German Pat. No. 2 422 655 are especially preferred for use in low-phosphate compositions which contain the softeners described herein.

The laundry compositions herein also preferably contain enzymes to enhance their through-the-wash cleaning performance on a variety of soils and strains. Amylase and protease enzymes suitable for use in detergents are well-known in the art and in commercially available liquid and granular detergents. Commercial detersive enzymes (preferably a mixture of amylase and protease) are typically used at levels of 0.001% to 2%, and higher, in the present compositions.

Moreover, the compositions herein can contain, in addition to ingredients already mentioned, various other optional ingredients typically used in commercial products to provide aesthetic or additional product performance benefits. Typical ingredients include pH regulants, perfumes, dyes, bleaches, optical brighteners, soil suspending agents, hydrotropes and gel-control agents, freeze-thaw stabilizers, bactericides preservatives, suds control agents, bleach activators and the like.

In a through-the-wash mode, the compositions are typically used at a concentration of at least 500 ppm, preferably 0.10% to 1.5%, in an aqueous laundry bath at pH 7–11 to launder fabrics. The laundering can be carried out over the range from 5° C. to the boil, with excellent results.

In an alternate mode, the quanternaries herein may be releasably adorbed or releasably coated onto a non-particulate substrate such as a non-woven or paper sheet or flexible sponge mat, or the like. Such sheet form objects may be added to the laundry or rinse bath, or to the laundry dryer, where the quaternary is released to provide fabric softening. In an alternate, and highly preferred, mode the quaternary is used in sheet form in combination with a bleach activator (such as tetraacetyl ethylene diamine or a straight- or branched-chain $C_6$–$C_{10}$ oxybenzene sulfonate) as a combined perborate-activator and softener in a laundry liquor. See, for example, U.S. Pat. No. 4,220,562, cited above.

Such sheet-form products will generally employ 1–20 grams of the quaternary and 1–20 grams of the bleach activator.

INDUSTRIAL APPLICATION

The following examples are typical of the preferred compositions of this invention, but are not intended to limite the scope of the invention.

EXAMPLE I

An aqueous crutcher mix comprising the following ingredients is prepared and spray-dried in standard fashion (percentages listed relate to percent ingredients in the complete formulation after spray-drying).

| Ingredients | Percent |
|---|---|
| $C_{11-12}$ alkyl benzene sulfonate | 6.2 |
| Tallow alcohol ethoxylate (EO11) | 1.0 |
| Sodium perborate | 20.0 |
| Sodium tripolyphosphate | 24.0 |
| Sodium sulfate | 22.0 |
| Sodium silicate | 8.0 |
| Smectite clay* | 2.4 |
| Ditallow methyl amine | 3.8 |
| Dioctyl dimethyl ammonium chloride | 1.6 |
| Carboxymethyl cellulose | 0.4 |
| Maleic/acrylate polymer (soil suspender) | 1.7 |
| Enzymes | 0.5 |
| Optical brightener | 0.23 |
| Sulphonated zinc phthalocyanine** | 25 ppm |
| EDTA | 0.2 |
| Perfume/copper salts/minors/brightener | 0.5 |
| Suds suppressor | 2.7 |
| Moisture | to 100 |

*Natural smectite; $CaCO_3$ ion exchange capacity above 50 meq/100 g clay
**U.S. Pat. No. 3 927 967

The composition of Example I is free-flowing and provides excellent cleaning and through-the-wash fabric softening.

The composition of Example I may be modified by adding 1.0% tetraacetyl of ethylenediamine (TAED) as a perborate bleach activator.

EXAMPLE II

A nil-P spray-dried detergent formulation is as follows:

| Ingredient | Percent |
|---|---|
| Zeolite A (1-10 micron) | 26.0 |
| Sodium nitrilotriacetate | 5.0 |
| Smectite clay* | 3.0 |
| Didecyl dimethyl ammonium chloride | 2.5 |
| $C_{11-12}$ alkyl benzene sulfonate (Na) | 6.5 |
| Tallow ethoxylate (EO 9-11) | 0.5 |
| Sodium perborate.$4H_2O$ | 20.0 |
| Sodium silicate | 8.0 |
| CMC | 1.0 |
| Sodium sulfate | 20.0 |
| Enzymes (1:1 amylase/protease) | 1.5 |
| Optical brightener | 0.5 |
| TAED | 1.2 |
| Water, minors | to 100 |

*As Gelwhite GP (TM); $CaCO_3$ ion exchange capacity >70 Meq/100 g.

The composition of Example II is prepared by spray-drying an aqueous crutcher mix. In use, the composition gives excellent cleaning and through-the-wash fabric softening performance.

EXAMPLE III

A laundry additive product is prepared by warming 6.5 g of didecyl dimethyl ammonium bromide and spreading the melt onto an ordinary disposable paper hand-towel (20×20 cm). TAED powder (1-10 microns) is sprinkled onto, and pressed into the melt before it has the chance to solidify.

The article of Example III is added to a laundry liquor containing a commercial perborate/clay detergent composition (DaSh-3; Trademark) to enhance through-the-wash softening and bleaching performance.

We claim:

1. A detergent composition comprising detersive surfactant, builders and other conventional detersive ingredients, and "2-7 wt. %" clay fabric softener, characterized in that it contains 1-5 wt % of a water-soluble -di-$C_1$-$C_4$, di- $C_6$-$C_{10}$ alkyl quaternary ammonium salt and not more than 3% by weight of alkoxylated nonionic detersive surfactant.

2. A composition according to claim 1 wherein the quaternary ammonium salt is selected from dioctyl dimethyl, didecyl dimethyl, octyl decyl dimethyl and dihexyldimethyl ammonium salts, and mixtures thereof.

3. A composition according to claim 1 wherein the clay fabric softener is the smectite clay.

4. A composition according to claim 3 wherein contains not more than 2% of an alkoxylated nonionic detersive surfactant.

5. A composition according to claim 4 which contains a detergency builder selected from phosphate, nitrilotriacetate, polycarboxylate, citrate and zeolite builders, or mixtures thereof.

6. A composition according to claim 1 which comprises:

(a) 1-5% of a water-soluble quaternary ammonium salt selected from dioctyl dimethyl ammonium, didecyl dimethyl ammonium, octyl decyl diethyl and dihexyldimethyl ammonium salts;

(b) 2-7% of a smectile clay softener, (c) 0-1% alkoxylated nonionic detersive surfactant; and (d) the balance comprising conventional detergent ingredients at conventional levels;

said composition being in the form of spray-dried granules.

7. A method of softening fabrics by contacting said fabrics with an aqueous solution comprising at least 500 ppm of composition according to claim.

8. A composition according to claim 5 wherein the detergency builder comprises zeolite A having a particle size of from 1 to 10 microns.

9. A composition according to claim 2 wherein the quaternary ammonium salt is a dioctyldimethyl ammonium salt.

* * * * *

UNITED STATES PATENT AND TRADEMARK OFFICE

CERTIFICATE OF CORRECTION

PATENT NO. : 4,806,253

DATED : February 21, 1989

INVENTOR(S) : James C.T.R. Burckett St. Laurent et al

It is certified that error appears in the above-identified patent and that said Letters Patent is hereby corrected as shown below:

Claim 3, column 6, line 11, change "the smectite" to --a smectite--.

Claim 4, column 6, line 12, change "wherein" to --which--.

Claim 6, column 6, line 23, change "diethyl" to --dimethyl--.

Claim 6, column 6, line 25, change "smectile" to --smectite--.

Claim 7, column 6, line 34, after "claim" insert --1--.

Signed and Sealed this

Twenty-ninth Day of August, 1989

*Attest:*

*Attesting Officer*

DONALD J. QUIGG

*Commissioner of Patents and Trademarks*